US009791116B2

(12) United States Patent
Mrakovich et al.

(10) Patent No.: US 9,791,116 B2
(45) Date of Patent: Oct. 17, 2017

(54) MODULAR LIGHT ENGINE FOR VARIABLE LIGHT PATTERN

(75) Inventors: Matthew S. Mrakovich, Streetsboro, OH (US); Mark J. Mayer, Sagamore Hills, OH (US); Thomas E. Zink, North Royalton, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 0 days.

(21) Appl. No.: 12/949,919

(22) Filed: Nov. 19, 2010

(65) Prior Publication Data

US 2012/0127709 A1 May 24, 2012

(51) Int. Cl.
*F21S 8/08* (2006.01)
*F21S 2/00* (2016.01)
*F21W 131/103* (2006.01)

(52) U.S. Cl.
CPC ..... *F21S 8/086* (2013.01); *F21S 2/005* (2013.01); *F21W 2131/103* (2013.01)

(58) Field of Classification Search
CPC ..... F21S 8/086
USPC ..... 362/431, 249.01, 249.02, 249.06, 236, 362/345, 346, 347
See application file for complete search history.

(56) References Cited

U.S. PATENT DOCUMENTS 4,893,223 A * 1/1990 Arnold ..... 362/11
5,690,417 A * 11/1997 Polidor et al. ..... 362/244
5,816,694 A 10/1998 Ideker et al.
5,906,425 A 5/1999 Gordin et al.
6,015,219 A * 1/2000 Kelly ..... 362/267
6,547,417 B2 * 4/2003 Lee ..... 362/249.01
6,659,632 B2 * 12/2003 Chen ..... 362/545
6,908,214 B2 * 6/2005 Luk ..... 362/249.02
7,021,803 B2 * 4/2006 Wong et al. ..... 362/507
D558,908 S 1/2008 Waedeled
7,407,304 B2 * 8/2008 Tasson ..... B60Q 1/2607 248/168
7,547,126 B2 6/2009 Hiratsuka
7,637,636 B2 * 12/2009 Zheng et al. ..... 362/294
7,934,851 B1 5/2011 Boissevain et al.
2005/0117326 A1 * 6/2005 Ma ..... 362/102
2008/0062689 A1 3/2008 Villard
2008/0180936 A1 * 7/2008 Ogashiwa ..... F21S 8/06 362/84
2008/0212329 A1 * 9/2008 Duguay ..... F21S 8/086 362/310
2009/0190345 A1 * 7/2009 Belliveau et al. ..... 362/231
2009/0244881 A1 10/2009 Butler
2009/0267525 A1 * 10/2009 Zheng et al. ..... 315/159
2009/0303718 A1 * 12/2009 Zheng ..... F21K 9/00 362/249.02
2010/0053963 A1 * 3/2010 Yang et al. ..... 362/249.02
2010/0103668 A1 4/2010 Lueken
(Continued)

FOREIGN PATENT DOCUMENTS

EP 1 956 290 8/2008
JP 3086473 U 3/2002
JP 2007-066658 A 3/2007

*Primary Examiner* — Julie Bannan
(74) *Attorney, Agent, or Firm* — Fay Sharpe LLP

(57) ABSTRACT

A light fixture suitable for illuminating a remote surface. The fixture includes a post adapted to receive at least two substantially identical light engine modules. Each module includes a plurality of light emitting diodes. Each module includes an edge adapted for mounting to the post.

12 Claims, 5 Drawing Sheets

(56) References Cited

U.S. PATENT DOCUMENTS

| | | | | |
|---|---|---|---|---|
| 2010/0103688 | A1* | 4/2010 | Riesebosch | 362/478 |
| 2010/0135017 | A1* | 6/2010 | Wulfinghoff | F21S 6/003 362/235 |
| 2011/0026253 | A1* | 2/2011 | Gill | F21V 15/01 362/249.02 |
| 2011/0188241 | A1* | 8/2011 | Walczak et al. | 362/235 |
| 2012/0075861 | A1* | 3/2012 | Yang | G03B 15/02 362/249.03 |
| 2012/0155088 | A1* | 6/2012 | Spaccasassi | F21V 14/02 362/249.04 |
| 2016/0025286 | A1* | 1/2016 | Wang | F21V 29/83 362/225 |

* cited by examiner

FIG. 8(a)
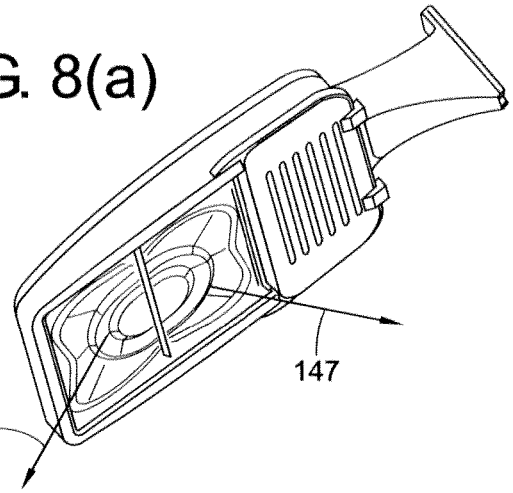
FIG. 8(b)
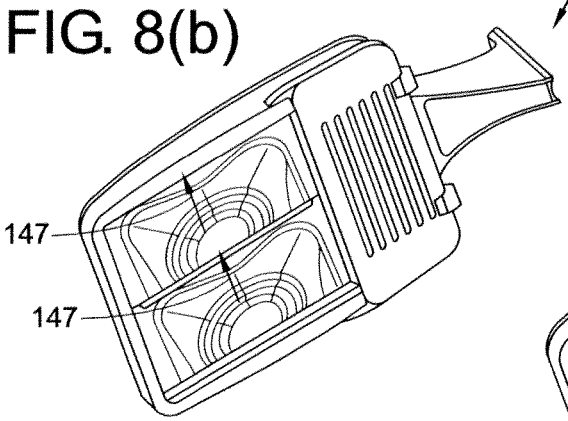
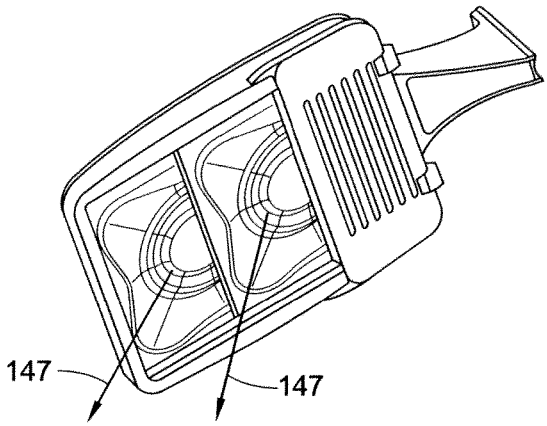
FIG. 8(c)
FIG. 8(d)
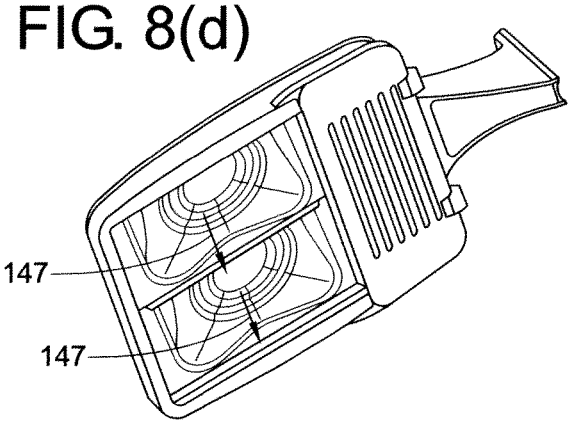

MODULAR LIGHT ENGINE FOR VARIABLE LIGHT PATTERN

BACKGROUND

The present disclosure relates to the art of lighting fixtures, and more particularly to area lighting fixtures for distributing patterns of light on the ground. These lighting fixtures can be used for area lighting, including street, parking lot, walkway, bicycle path, or other similar applications. Additionally, these lighting fixtures can be employed for indoor applications, such as, illuminating basketball or factory building floors.

In general, lighting fixtures consist of a lamp or other light source, and a reflector for reflecting light from the light source. The shape of the reflector and any shielding typically define the light distribution pattern. More particularly, the light pattern is either controlled by external shielding, for high intensity discharge lamps, or by an optical package for light emitting diode packages. Since shielding is an inefficient blocking of otherwise useable light, the HID solution wastes light power that is not directed in the desired direction.

Light energy spreads over distance. The illumination of a remote area therefore varies inversely as the square of the distance from the light source. Additionally, since light fixtures directing light to a relatively large target area, the light source is many times smaller than the area to be lighted. Accordingly, the beam of light energy produced by each fixture must be relatively intense to cover a substantial area.

These characteristics present certain lighting problems. First of all, to maintain a given light level at a distant target area, the light source must produce a much higher level of light energy at the source. This can contribute to glare problems for those viewing the fixtures. Secondly, the use of diverging or converging beams can result in a significant amount of light falling outside the target area. This results in spill. Spill and glare are inefficient use of the light and are frequently objectionable.

Spill in parking, street and highway lighting results in wide-scale lighting of areas, which makes the actual roadway less distinct from surrounding areas. Additionally, lack of control also translates, in many applications, into the utilization of more light poles and lighting fixtures, which is expensive and consumes substantial resources.

Also, most existing light systems have broadcast or spread light over as much of the highway or roadway as possible. However, by doing so, some light is most times projected toward the driver rather than away from the driver in the driver's viewing direction for each lane of the highway. This can contribute to glare for drivers on the roadway.

In certain environments, square distribution lighting fixtures may be preferred by lighting architects. To illuminate a parking lot, for example, the lighting architect can employ fewer lighting fixtures because overlap of distribution patterns can be eliminated. Additionally, lighting architects can eliminate spill at the corners and edges of the parking lot by using a square lighting distribution. Alternatively, round or oval light distributions can be the most efficient wherein little or no shielding of light is necessary.

Having a light engine which is selectively modifyable to provide a wide array of light distribution patterns allows precise control of light. One advantage of the present disclosure is that by providing an adaptable modular lighting fixture, it is feasible to readily select fixture modules having suitable light distribution and orientation to properly light almost any area or shape with minimal spill and limited viewer glare.

BRIEF DESCRIPTION

According to one embodiment, a light fixture suitable for illuminating a remote surface is provided. The fixture comprises a post adapted to receive at least two substantially identical light engine modules. The modules include a plurality of light emitting diodes. Each module has a light emitting diode inclusive surface and an opposed surface. Each module further includes an edge adapted for mounting to the post. The fixture also includes an electrical path for providing electrical power to the modules.

According to another embodiment, a light fixture comprising a post adapted to selectively receive up to four light emitting diode modules is provided. Each module comprises a first edge adapted for mating with the post and a second arcuate edge extending approximately 90°. The light fixture can include four modules to form a substantially circular shape.

According to a third embodiment, a light engine module for a light fixture is provided. The module comprises a body housing at least two separable light emitting diode arrays. An electronic conversion element for converting AC to DC is also provided. The module further includes a mounting arm extending from the body.

According to a further embodiment, a light fixture is provided. The fixture includes a post having at least two light engine modules mounted thereto. The modules include at least two light emitting diode arrays wherein the light emitting diodes are in a substantially hemispherical distribution. The arrays of the first module are oriented relative to one another differently than the arrays of the second module.

BRIEF DESCRIPTION OF THE DRAWINGS

FIGS. 8 (*a*), (*b*), (*c*) and (*d*) demonstrate the further adaptability of the modules achieved via orientation of the LED arrays.

DETAILED DESCRIPTION

Figure 2:
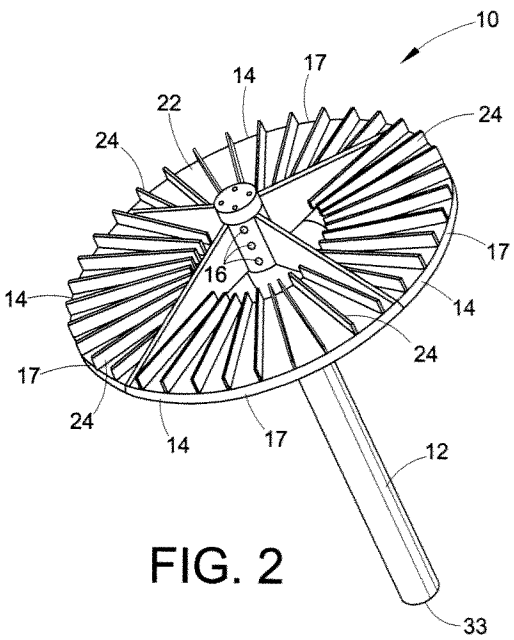
FIG. 2 is a top perspective view of the assembly of FIG. 1.
Figure 1:
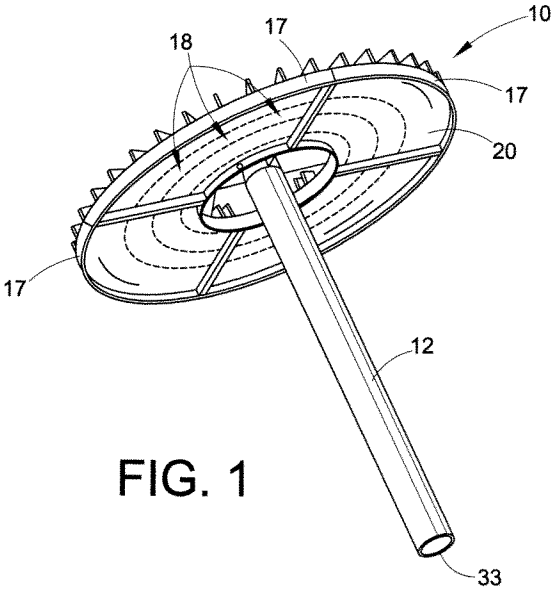
FIG. 1 is a bottom perspective view of a modular area light fixture assembly.

Referring now to FIGS. 1 and 2, a modular area light fixture 10 is depicted. Fixture 10 includes post 12 to which light modules 14 are removably mounted via screws or bolts 16. With four modules 14 secured to post 12, a light pattern extending 360° is provided. Moreover, each module 14 comprises a sector of a circle having an arcuate outer edge 17 traversing approximately 90°.

More particularly, each module 14 includes LEDs (light emitting diodes) 18 disposed upon a bottom surface 20.

Surface 20 can be reflective to improve light extraction from the fixture. Top surface 22 of each module 14 includes a plurality of vanes 24 to enhance heat dissipation.

Figure 3:
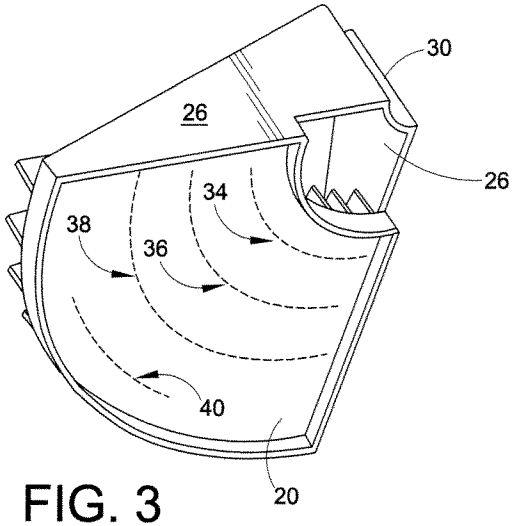
FIG. 3 is a bottom perspective view of an individual lamp module.
Figure 4:
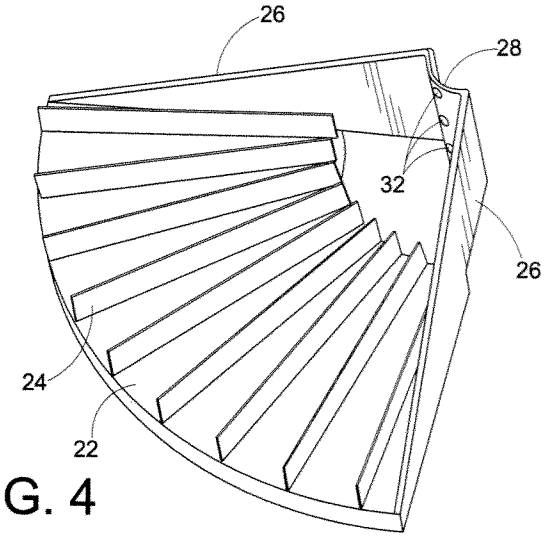
FIG. 4 is is a top perspective view of the module of FIG. 3.

Referring now to FIGS. 3 and 4, an individual light module 14 is depicted. The individual light module 14 encompasses an area of approximately 90°. In this regard, each module represents a one quarter sector of a circle. The sides of the module 14 are bounded by shoulder elements 26 which meet at inner edge 28 to form a collar element 30. Collar element 30 includes an arcuate shaped surface which is cooperative with the outer surface of post 12. Of course, any suitable cooperative shape between the post and collar element 30 will be acceptable. Passages 32 are formed in collar element 30 to facilitate the removeable attachment of module 14 via bolts or screws to post 12. Some type of mating between the shoulder elements 26 of adjacent modules, such as a clip or other mechanical joinder, may be desirable to increase overall light fixture strength. Power is provided between an end 33 of post 12 via flexible conductors or other circuitry (not shown) and the individual LED arrays.

Turning now to FIG. 3, the LEDs 18 are disposed in four generally concentric arrays 34, 36, 38 and 40. The LEDs are set in concentric arcuate paths. When all four modules 14 are in place, several concentric rings of LEDs are formed (see FIG. 1). Of course, any type of LED distribution on surface 20 as dictated by the desired light distribution for the particular application is contemplated by the present disclosure. The LEDs can be of any type known to the skilled artisan including white light generating, saturated color generating of a mixture thereof. In addition, the LEDs can be individually packaged to include an integral optical element or the LEDs can be unpackaged and an optical element could be formed over the entire surface 20.

Figure 5:
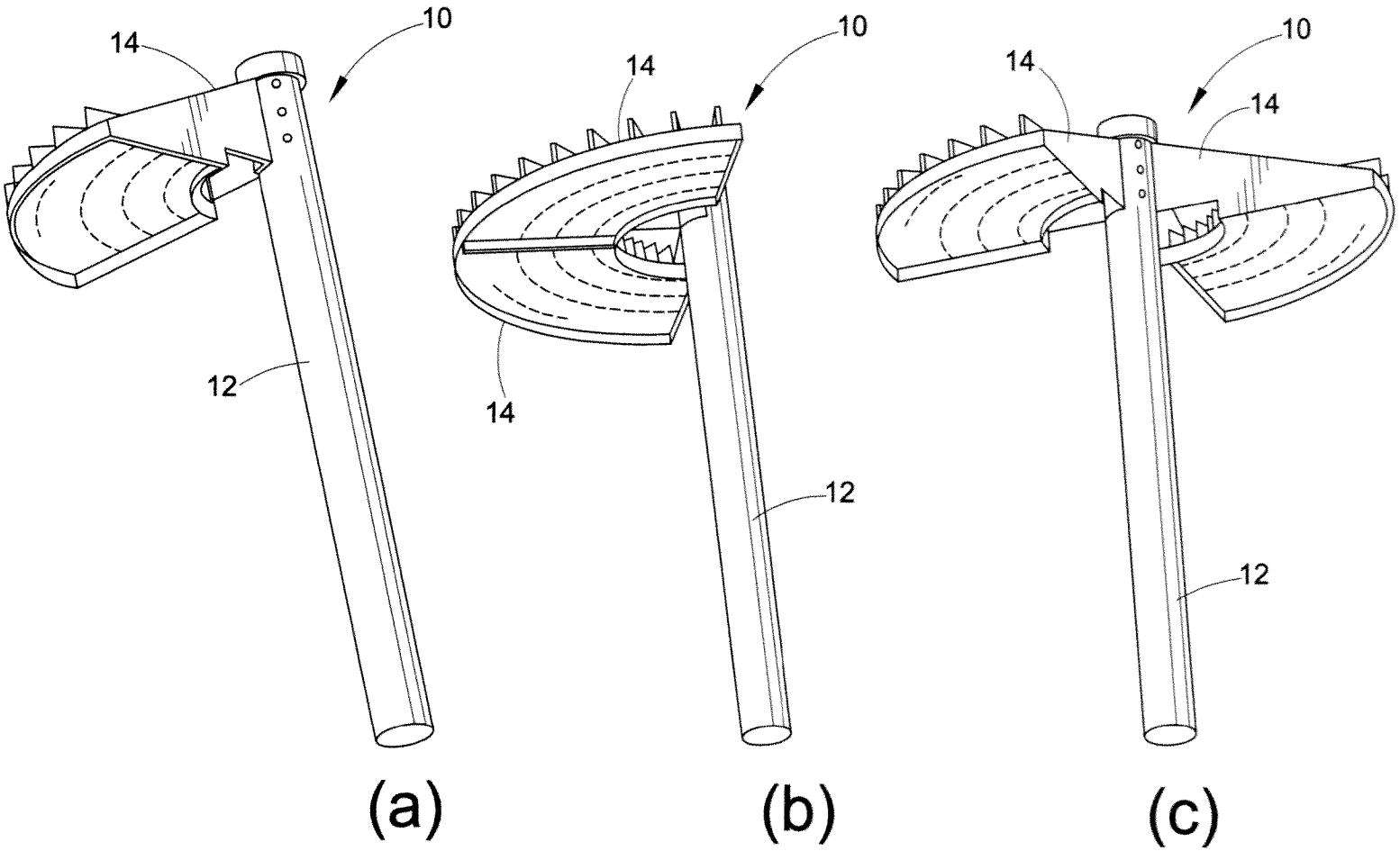
FIGS. 5 (*a*), (*b*) and (*c*) are perspective views demonstrating the adaptability of the present assembly.

Turning next to FIG. 5, the functionality achievable by the modularity of the light fixture 10 is demonstrated. Moreover, in FIG. 5(*a*), by providing a single module 14 on post 12, a light dispersion of approximately 90° can be obtained. In this regard, placing the fixture of FIG. 5(*a*) in, for example, the corner of a parking lot, could provide suitable lighting of the corner area without light spill outside of the parking area.

Turning now to FIG. 5(*b*), approximately 180° of light distribution is provided by light fixture 10 which includes two adjacent modules 14. This light distribution could be suitable, for example, in lighting of an edge of a parking area, or a sidewalk or other applications wherein a linear demarcation exists between the area to be lit and an outlying area.

Referring now to FIG. 5(*c*), a symmetric light distribution pattern is provided by including two modules 14 an opposed sides of post 12. This orientation can be used when, for example, illuminating a central area of a parking area or perhaps down the center of a highway where lanes on each side are being illuminated.

Figure 6:
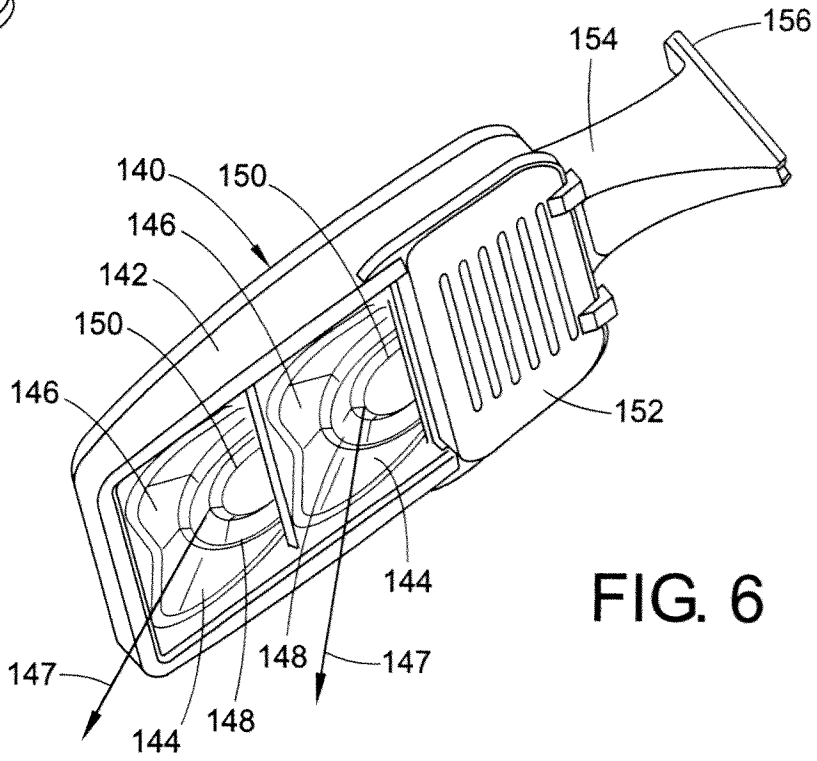
FIG. 6 is a bottom perspective view of an alternative module design.
Figure 7:
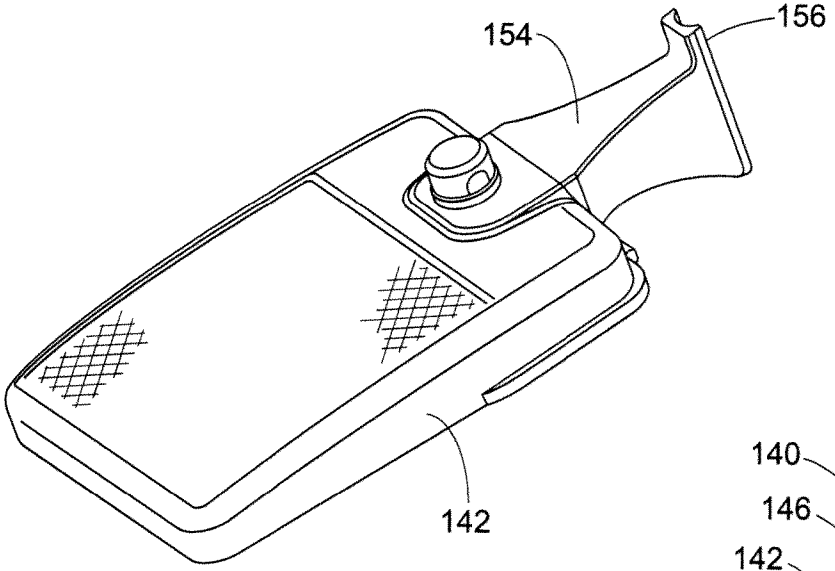
FIG. 7 is a top perspective view of the module of FIG. 6.

Referring now to FIGS. 6 and 7, an alternative design of a module 140 is depicted. Module 140 includes a housing 142, within which a pair of LED arrays 144 are disposed. LED arrays 144 are substantially identical units which can be individually attached to module 140 and separately powered. LED arrays 144 are more particularly comprised of a reflective substrate 146 upon which a plurality of hemispherical LED arrays 148 and 150 are disposed. As shown reflective substrate 146 includes a surface shaped to create a slightly directed (see arrows 147) light distribution. Housing 142 further includes a compartment covered by a door 152 which includes electronic circuitry (not shown) for converting alternating current to direct current. Housing 142 is further provided with an arm 154 including bracket 156 suitable for mating with a post.

Turning now to FIG. 8, the ability of the present embodiment to provide highly tuned light distributions is depicted. Moreover, in addition to the ability to have between 90 and 360° of light distribution (see FIG. 5), each individual module can be tailored by modifying the orientation of LED arrays 144. For example, with reference to FIG. 8(*a*), LED arrays 144 are oriented with opposed array directions such that a symmetrical light distribution (i.e., 360° from the module) is provided. In contrast, referring to FIG. 8(*b*) an asymmetric right light distribution (147) and in FIG. 8(*d*) and an asymmetric left light distribution (147) is provided. This can advantageously direct light down onto a street but also canted in the direction a vehicle is being driven. In this manner, glare experienced by the vehicle operator can be reduced. With further reference to 8(*c*), a forward light distribution (147) is provided.

The present disclosure describes modules allowing the number placed on a pole along with the orientation on the pole to dictate the illumination pattern on the ground. This can reduce the acquisition cost since only the number of modules required on each pole must be purchased. Furthermore, since the modules are substantially identical the production costs can be controlled. There are not different part numbers to track and manufacture for various light patterns, because only one light engine module that can satisfy all light patterns needed. Similarly, since the same heat sink and other parts can be used, cost of manufacturing and maintenance is reduced. However, the modules can be attached to the post in varying numbers, e.g., 1 to 4, and since the LED arrays in each module can be oriented left, right or forward, as desired, the light pattern emitted by the fixture is highly flexible.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A light fixture for illuminating a parking lot or street comprising a post adapted to engage the ground at a first end and receive at least two light engine modules at an opposite end, said modules including a plurality of light emitting diodes disposed on a planar surface, said light emitting diodes being disposed in at least two generally concentric semi-circular arrays, said arrays disposed in a shared plane, said modules being at least substantially identical, each module including a light emitting diode inclusive surface and an opposed surface, said opposed surface including a plurality of vanes, wherein each module includes sides that are bounded by shoulders extending perpendicularly from said opposed surface and wherein said shoulders meet at an edge rigidly mounted to said post and wherein each module is individually secured to said post such that the planar surface of each module permanently resides in a plane perpendicular to a longitudinal axis of the post, said fixture further comprising an electrical path for providing electrical power to said modules, and wherein said light engine modules are spaced from the ground such that the area of the light engine modules is less than an area of the ground lighted by said fixture.

2. The fixture of claim 1 consisting of four modules.

3. The fixture of claim 1 wherein said edge adapted for mounting to said post resides in at least substantially the same plane as said vanes.

4. The fixture of claim 1 wherein said light emitting diode including surface is reflective.

5. A light fixture for illuminating a parking lot or street comprising a pole having a longitudinal axis and including at least two light engine modules mounted to said pole via a mounting arm; each of said modules including a door selectively sealing a compartment housing electronic circuitry; each of said modules including at least two light emitting diode arrays; each of said arrays disposed in a generally common plane, said arrays comprising a substantially semi-circular distribution of diodes, wherein the arrays of a first module are oriented relative to one another differently than the arrays of a second module, wherein said common plane is generally tangential to the longitudinal axis of said pole, and wherein said light engine modules are mounted to an end of said pole remote from the ground.

6. The light fixture of claim 5 wherein said light emitting diode arrays comprise at least two concentric substantially semi-circular distributions of diodes.

7. The light fixture of claim 5 wherein the arrays of a first light engine module are oriented in an opposed direction and emit a symmetric light pattern and the arrays of a second light engine module are oriented in the same direction and emit an asymmetric light pattern.

8. The light fixture of claim 7 wherein said asymmetric light pattern is one of asymmetric forward, right or left.

9. The light fixture of claim 5 further comprising an electronic conversion element disposed within a housing of said module and accessible by a selectively openable door.

10. The light fixture of claim 5 wherein said light emitting diode arrays are substantially identical.

11. The light fixture of claim 2, wherein the light emitting diode arrays of the four modules are configured to cooperatively form at least two circular distributions of light emitting diodes.

12. The light fixture of claim 1, wherein each module includes a passage between the planar surface and the edge for mounting.

* * * * *